United States Patent [19]

Ketner et al.

[11] 4,271,975

[45] Jun. 9, 1981

[54] LIGHTWEIGHT CARGO CONTAINER AND FITTINGS

[75] Inventors: Clyde R. Ketner, Sumner; Philip C. Whitener, Seattle, both of Wash.

[73] Assignee: The Boeing Company, Seattle, Wash.

[21] Appl. No.: 69,218

[22] Filed: Aug. 23, 1979

[51] Int. Cl.[3] ..... B65D 6/28; B65D 90/08

[52] U.S. Cl. ..... 220/80; 52/282; 217/65; 220/1.5

[58] Field of Search ..... 220/1.5, 84, 80; 52/282; 296/205, 29, 30, 35.1, 35.3; 217/65

[56] References Cited

U.S. PATENT DOCUMENTS

| | | | |
|---|---|---|---|
| 2,388,297 | 11/1945 | Slaughter | 52/282 X |
| 2,578,644 | 12/1951 | Mautner | 220/84 X |
| 3,156,370 | 11/1964 | Monfort | 217/65 X |
| 3,338,012 | 8/1967 | Kappenhagen | 52/282 |
| 3,375,950 | 4/1968 | Chieger | 220/1.5 |
| 3,463,526 | 8/1969 | Benincasa et al. | 52/282 X |
| 3,485,405 | 12/1969 | Dement | 52/282 X |
| 3,561,633 | 2/1971 | Morrison | 220/1.5 |
| 3,587,900 | 6/1971 | Millar et al. | 220/1.5 X |
| 3,598,273 | 4/1971 | Rau et al. | 220/1.5 |
| 3,715,136 | 2/1973 | Yoshida | 217/65 X |
| 3,724,701 | 4/1973 | Barkow | 217/65 |
| 3,798,859 | 3/1974 | de Jong | 52/282 X |
| 3,915,327 | 10/1975 | Lovich et al. | 220/1.5 |

FOREIGN PATENT DOCUMENTS

| | | | |
|---|---|---|---|
| 202340 | 7/1956 | Australia | 52/282 |
| 1341559 | 12/1973 | United Kingdom | 220/1.5 |

*Primary Examiner*—Allan N. Shoap

*Attorney, Agent, or Firm*—Ronald E. Suter; Bernard A. Donahue

[57] ABSTRACT

A lightweight cargo container and fitting for the construction thereof are disclosed. The fitting has a simple cross-sectional shape so that it may be inexpensively manufactured of lightweight materials, yet it provides an easily assembled, secure connection between wall panels of a lightweight container.

3 Claims, 6 Drawing Figures

Fig. 2
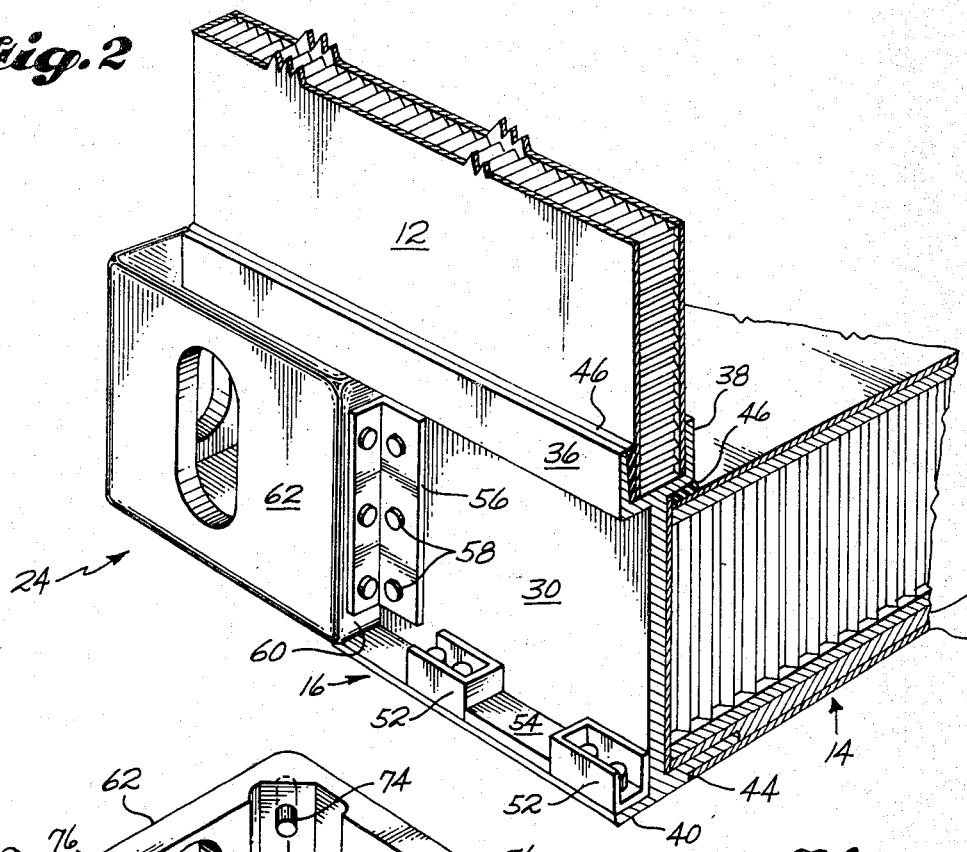
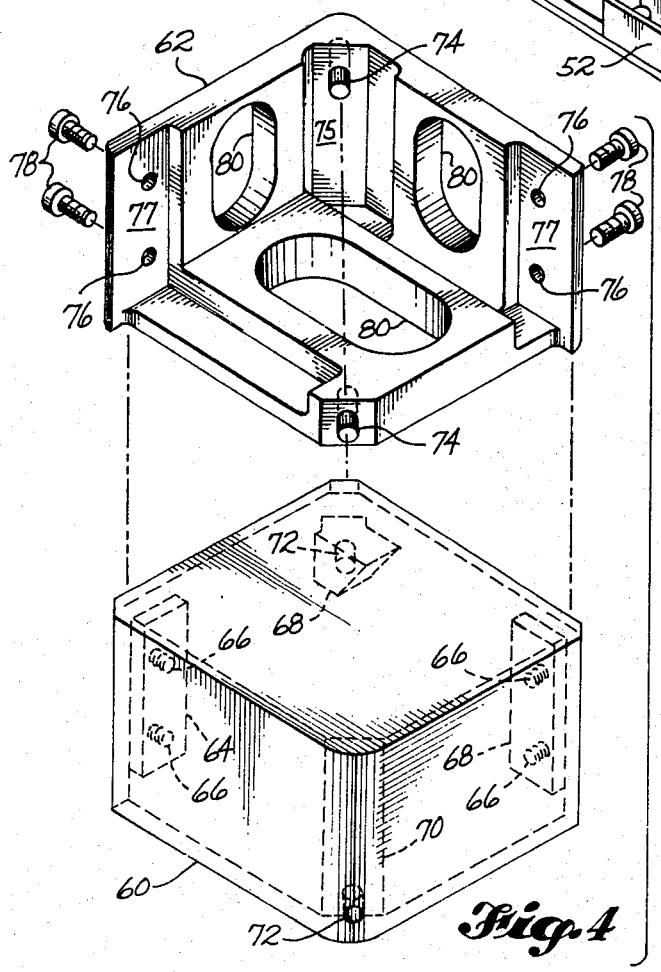
Fig. 4
Fig. 3
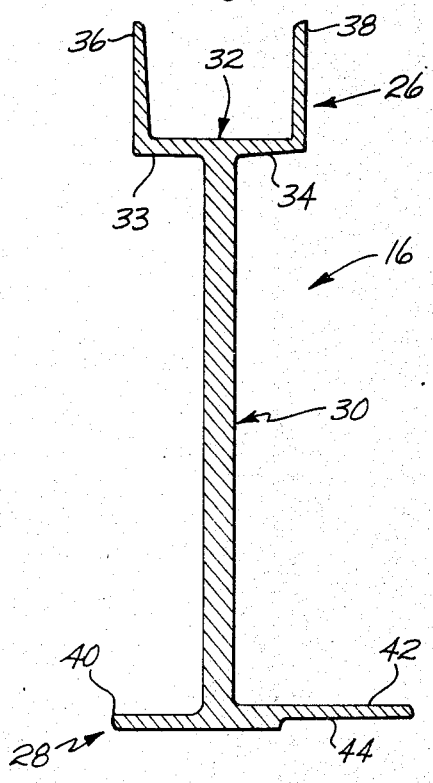

LIGHTWEIGHT CARGO CONTAINER AND FITTINGS

CROSS-REFERENCE TO RELATED APPLICATION

This application is related to U.S. patent application Ser. No. 69,219, filed concurrently herewith, entitled "Lightweight Cargo Container and Fittings", by Clyde R. Ketner.

BACKGROUND OF THE INVENTION

1. Field of the Invention

This invention relates generally to cargo containers and their construction and, more particularly to the construction of lightweight cargo containers dimensioned to International Standards Organization (ISO) specifications. Although this invention finds particular utility in cargo containers intended for air transport, it is expressly to be understood that the advantages of the invention are equally manifest in other types and sizes of containers, wherever strength, low cost and reduced weight are desired.

2. Background of the Invention

Cargo is frequently shipped in bulk containers to reduce handling and expedite loading and unloading operations. To facilitate handling of these containers, various characteristics such as dimensions, strength requirements and fittings have been standardized under guidelines promulgated by the ISO. In order to comply with these guidelines, most containers of this type are constructed of steel or aluminum and are quite heavy. Joints are frequently welded or bolted and sealed, requiring substantial assembly time and adding weight. Because they are rather bulky and heavy, intital use of these containers has been limited to various means of land or sea transport. The introduction of wide-body aircraft has caused air shipment of ISO containers to be more seriously considered, however their weight continues to reduce aircraft payload to such an extent as to make their use economically impractical under most circumstances.

Prior attempts to produce a lightweight container capable of meeting ISO Standards have encountered numerous difficulties. Frequently these lightweight containers are unable to satisfactorily withstand the abuse of repeated loading and unloading. Container corner fittings of lightweight material frequently suffer handling damage requiring the container to be removed from service for extensive repairs. Prior lightweight containers require a complex assembly procedure which is both time consuming and costly.

It is, accordingly, an object of the invention to provide a lightweight cargo container that overcomes the disadvantages and limitations of the prior art.

It is another object of the invention to provide an easily manufactured fitting that permits secure attachment of container walls to each other.

It is yet another object of the invention to provide a lightweight cargo container that may be easily assembled.

SUMMARY OF THE INVENTION

Briefly, these and other objects are achieved in accordance with the structural aspects of an example of the invention in which an easily manufactured wall connecting fitting may be used to securely connect lightweight walls in the construction of a lightweight cargo container. The simple, continuous cross section of the fitting permit inexpensive manufacture by extrusion. The fitting may also be provided with surface irregularities against which tools may be rested to aid in the construction and assembly of the container.

Further details of these and other novel features, their operation and cooperation as well as additional objects and advantages will become apparent from a consideration of the following description and accompanying drawing which is provided by way of illustrative example only.

BRIEF DESCRIPTION OF THE DRAWING

FIG. 2 is a cutaway perspective view of a portion of the container of FIG. 1 showing the side rail fitting and walls in more detail.

FIG. 3 is a cross-sectional view of the side rail fitting.

FIG. 4 is an exploded perspective view of the protective corner fitting.

DESCRIPTION OF THE PREFERRED EMBODIMENTS

Figure 1:
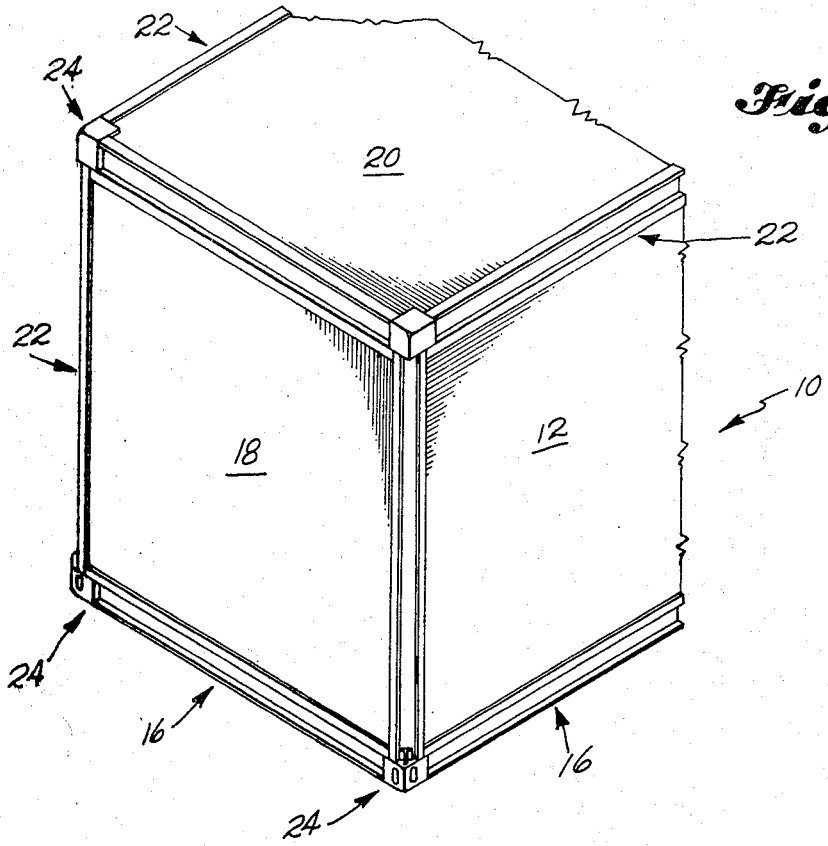
FIG. 1 is a partial perspective view of a lighweight container embodying the fittings of the invention.

With reference now to the figures in detail, it is again stressed that the particulars shown are by way of illustrative example only and are not to be taken as a limitation on the scope of the invention which is defined by the appended claims forming, along with the drawing, a part of this specification.

In FIG. 1 a container, generally designated 10, is shown. Container 10 includes side walls 12 (only one shown) secured to bottom wall or floor 14 (see FIG. 2) by a side rail, generally designated 16. Side walls 12 are secured to end walls 18 (only one shown) and top wall 20 by wall connecting fittings, generally designated 22. Similarly, end walls 18 are secured to top wall 20 by fittings 22. Obviously, one or both end walls 18 may be provided with some conventional form of door to permit access to the interior of container 10. End walls 18 may also be connected to bottom wall 14 by side rails 16. At each corner of container 10 a protective corner fitting, generally designated 24 is provided.

Turning now to FIGS. 2 and 3, side rail 16 will be described in more detail. Rail 16 includes a rigid upper, generally U-shaped portion 26, a lower, generally planar base 28 and a web 30 extending between and integrally connecting said upper portion 26 and said base 28. U-shaped portion 26 is formed by a bight 32, which is in turn formed by two bight portions 33, 34, extending generally orthogonally away from opposite sides of one end of web 30, and two arms 36, 38. Each of said arms 36, 38 extends away from a respective one of said bight portions 32, 34 in a direction substantially perpendicular to said bight and parallel to said web 30. Base 28 is formed by two base portions 40, 42 extending generally orthogonally away from opposite sides of the other end of web 30. As seen most clearly in FIG. 3, one of arms 36, 38 tapers gradually from root to tip so that the space between arms 34 and 36 becomes greater toward the tips thereof. Similarly, the lower surface, i.e. that surface opposite arm 38, of bight portion 34 tapers gradually away from the upper surface of base portion 42.

The opposite or lower surface of base portion 42 is provided with a cut out or recess 44, the purpose of which will be described in greater detail infra. The simple cross- sectional shape of side rail 16 permits inexpensive manufacture, for example by simple extrusion, from any desired lightweight yet sufficiently strong material, such as aluminum. Such extrusions could, of course, be formed as long sections and then be cut to the desired lengths.

The utilization of side rail 16 in the construction of container 10 is shown more clearly in FIG. 2. Side and bottom walls, 12 and 14 respectively, may be of any known, lightweight construction, such as honeycomb/-face sheet laminate. The side wall 12 is secured in the upper, U-shaped portion 26 of side rail 10 by a suitable, conventional adhesive and a wedge 46. The aforementioned taper of arm 36 permits wedge 46 to be forced between the tapered interior surface thereof and the outer surface of wall 12 after adhesive has been applied. Wedge 46 thus serve not only to provide a clamping force during curing of the adhesive, but also to absorb any tolerance mismatch between the wall and fitting. This permits side rail 16 and walls 12 to be manufactured without the need to maintain close tolerances and required no subsequent machining operations. In a substantially similar manner, bottom wall 14 is adhesively secured between the lower tapered surface of bight portion 34 and base portion 42. Due to the extra loads carried by the bottom wall or floor 14 and to the need for a smooth lower container surface, base portion 42 is inserted between laminations 48 and 50 which form part of the lower face sheet of the honeycomb composite. Recess 44 is substantially identical in depth to the height of lamination 48, such that, in the assembled condition (FIG. 2), a smooth transition between the lower surfaces of side rail 16 and floor 14 is formed. This permits container 10 to be easily moved over cargo handling rollers when necessary.

Containers of the type described are required by ISO specifications to provide means for securing the container to the transporting vehicle. Side rail 16 permits this requirement to be met with minimum added weight while, at the same time, permitting simple replacement thereof in the event of damage. As shown in FIG. 2, a pair of restraint blocks 52 are removably secured to the upper surface of base portion 40. Blocks 52 are separated by a rub strip 54 which serves not only as the surface against which a container hold down (not shown) acts, but also as a spacer to raise the attachment surface to the ISO specified height. In the event either block 52 or strip 54 is damaged, it may be easily replaced without removing container 10 from service for any lengthy period of time.

To provide secure attachment between side rail 16 and corner 24, a clip 56 is provided. A plurality of bolts 58 secure clip 56 to web 30 and corner 24. Other means of securing clip 58, such as welding, could also be used. It is also noted that sections of base 28 and web 30 have been cut away to permit the upper portion of rail 16 to extend over corner 24 to strengthen the connection therebetween.

FIG. 4 shows an exploded view of protective corner 24. Corner 24 includes a fixed portion 60, adapted to be permenently fixed to the container 10, and a removable portion 62. Since fixed portion 60 is substantially protected on all sides from severe impact, it may be formed of almost any lightweight material, such as aluminum or fiberglass. It must, however, be capable of securely holding removable portion 62 in place. Fixed portion 60 is provided with a pair of outwardly extending flanges 64, each of which carries a plurality of fastening means such as nutplates or threaded bores 66. Portion 60 also carries a further flange 68 and a fillet 70, which are each provided with a smooth bore 72. Removable portion 62 carries a pair of pins 74, one of which is carried in a fillet 75. Pins 74, in the assembled condition, mate with and extend into bores 72, to carry shear loads. Portion 62 also carries a plurality of bores 76 in recesses 77 which, in the assembled condition, align with bores 66. Bolts 78 pass through bores 76 and are threadably received in bores 66 to secure the two-part corner together and carry moments. Holes 80 are provided in their standard ISO locations to serve as attachment points for the handling, lifting, etc. of container 10.

Figure 5:
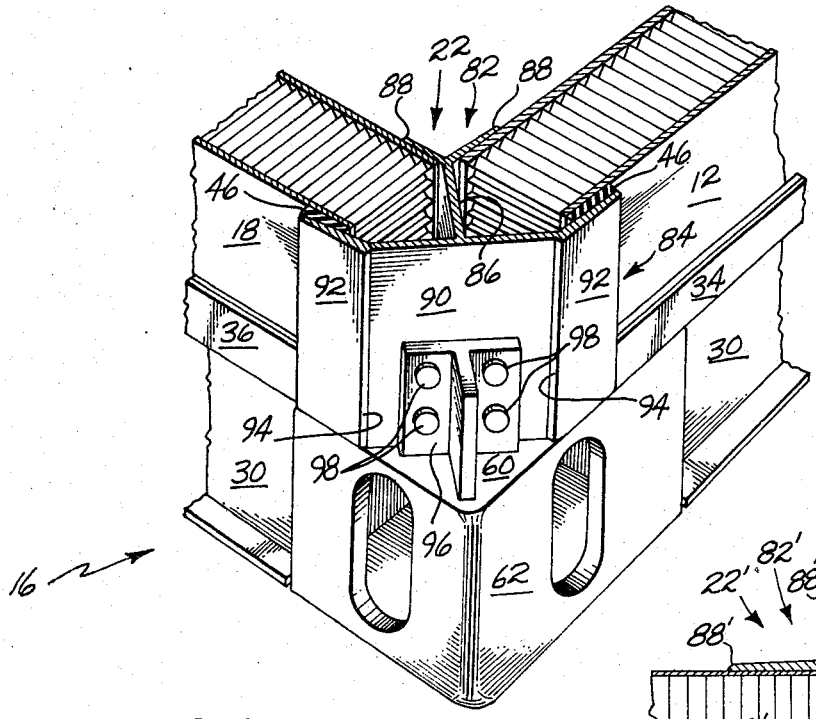
FIG. 5 is a perspective view of the wall connecting fitting.

Turning now to FIG. 5, a portion of container 10 exhibiting one embodiment of wall connecting fitting 22 is shown in more detail. For purposes of simplicity, this fitting is shown only in relation to a side wall 12 and an end wall 18, however, as noted with regard to FIG. 1, this same fitting may be used at other locations. Fitting 22 is formed by an inner flange generally designated 82, an outer flange generally designated 84 and a connecting web 86 integrally extending therebetween. Inner flange 82 is formed by a pair of inner flange portions 88 which extend obliquely away from opposite sides of the inner end of web 86. Outer flange 84 is formed by a central portion 90 which is integrally attached substantially at its midpoint, to the outer end of web 86. Central portion 90 in this embodiment of fitting 22, extends on opposite sides of its midpoint in a direction substantially perpendicular to web 86. Integrally formed on each of the opposite sides of central portion 90 is an outer flange portion 92, each of which extend obliquely away from central portion 90. Inner and outer flange portions, 88 and 92 respectively, on each side of web 86 are oriented to be substantially parallel. However, the inner surfaces of at least one of flange portions 88 or 92 on each sid of said web are tapered from root to tip so that the space between portions 88 and 92 on each side of web 86 increases in a direction away from web 86. Walls 12 and 18 may be secured within these spaces between portions 88 and 92, using an adhesive and a wedge 46, as discussed supra with regard to side rail 16. To facilitate the insertion of wedges 46, fitting 22 may be provided with reaction surfaces 94 at the junctions between central portion 90 and outer flange portions 92. Surfaces 94 provide a means whereby one part of a clamping tool (not shown) may be rested while the other part thereof applies an appropriate force against a wedge 46. As shown, a T-flange 96 may be secured, as by welding, to the fixed portion 60 of corner 24. Flange 96 is provided with bores (not shown) through which bolts 98 may pass into a fastening means such as threaded bores or blind fasteners (not shown) in fitting 22. In this manner applied loads are effectively carried and distributed between the various container components. Once again the simple cross-sectional design of fitting 22 permits inexpensive manufacture, such as by extrusion.

Figure 6:
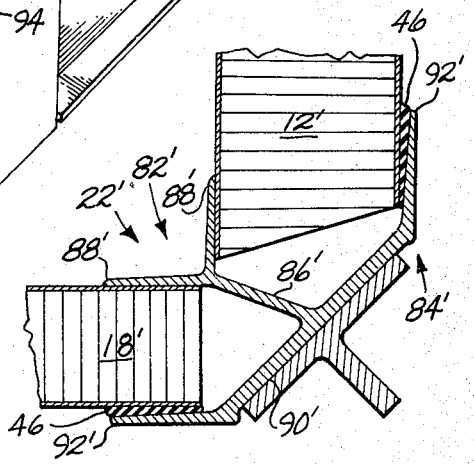
FIG. 6 is a cross-sectional view of a different embodiment of the fitting of FIG. 5.

In some applications, the various wall members may be different thicknesses. The wall connecting fitting 22' shown in FIG. 6 will accommodate such an arrangement. As disscussed with regard to fitting 22, the embodiment 22' includes an inner flange 82', and outer flange 84' and a connecting web 86' integrally extending therebetween. Since side wall 12 is thicker than end wall 18', the outer end of web 86 extends obliquely away from the central portion 90' of outer flange 86'. As is also apparent, inner flange portions 88' extend at different angles with respect to the inner end of web 86'. The angles at which portions 88' extend are selected to once again produce an increasing distance between themselves and their respective outer flange portions 92' in a direction from root to tip. As before, a wedge 46' is shown between the wall member 18 or 12 and the outer flange portion 92', however, it could equally well be located between the wall member 12, 18 and the inner flange portion 88' if desired.

There has thus been disclosed and described a lightweight, easily assembled cargo container, its construction, and the fittings therefor, which exhibit the advantages and achieves the objects set forth hereinabove.

What is claimed is:

1. A wall connecting fitting for a lightweight cargo container, said fitting comprising an outer flange;

an inner flange; and a web integrally connecting the outer and inner flanges;

said outer flange comprising a generally rectangular, substantially planar central portion, a first outer flange portion integrally attached to one edge of said central portion and a second outer flange portion integrally attached to an opposite, parallel edge of said central portion, the first and second outer flange portions extending obliquely with respect to said central portion said first and second outer flange portions each having an inner and outer surface; said web being integrally connected at one end thereof to one side of said central portion substantially midway between the edges and extending generally perpendicularly with respect to said central portion; and a reaction surface at the connection of each of said first and second outer flange portions with said central portion, each reaction surface being located on a side of said central portion opposite said one side, protruding outwardly therefrom and extending substantially perpendicular to the outer surface of the respective outer flange portion, for applying a clamping tool thereagainst;

said inner flange comprising a pair of inner flange portions integrally connected to each other and to the other end of said web and extending obliquely with respect to said web;

at least one of said outer and inner flange portions on each side of said web having a tapered cross-section in a direction away from said web such that the distance between the outer and inner flange portions on each side of said web increases in a direction away from said web.

2. A wall connecting fitting as claimed in claim 1 further comprising a first lightweight wall inserted between said first outer flange portion and its opposed inner flange portion;

a second lightweight wall inserted between said second outer flange portion and its opposed inner flange portion;

a wedge inserted between at least one of said inner and outer flange portions on each side of said web and the first and second walls, respectively; and adhesive means for securing each said wall and wedge to said fitting.

3. A wall connecting fitting as claimed in claim 2, further comprising at least two threaded bores in said central portion.

* * * * *